United States Patent [19]

Farris

[11] 3,934,306

[45] Jan. 27, 1976

[54] DOOR CLOSURE DEVICE

[75] Inventor: Vernie L. Farris, Houston, Tex.

[73] Assignee: Federal Sign and Signal Corporation, Blue Island, Ill.

[22] Filed: Jan. 6, 1975

[21] Appl. No.: 538,762

[52] U.S. Cl. ..... 16/48.5; 188/77 W; 16/70

[51] Int. Cl.[2] ..... E05F 15/20

[58] Field of Search ..... 16/48.5, 63, 67, 82, 84, 16/49; 188/77 W, 82.6, 271, 302

[56] References Cited

UNITED STATES PATENTS

| | | | |
|---|---|---|---|
| 2,098,501 | 11/1937 | Lasier | 16/49 X |
| 2,874,960 | 2/1959 | Durbin et al. | 16/82 X |
| 3,038,195 | 6/1962 | Bardfeld | 16/49 |
| 3,405,791 | 10/1968 | Kaplan | 188/77 W X |
| 3,648,326 | 3/1972 | Gaysowski | 16/48.5 UX |
| 3,777,423 | 12/1973 | Coulter | 16/48.5 X |
| 3,778,866 | 12/1973 | Nakanishi | 16/49 |

*Primary Examiner*—Werner H. Schroeder
*Assistant Examiner*—Wayne L. Shedd
*Attorney, Agent, or Firm*—Charles F. Pigott, Jr.

[57] ABSTRACT

A safety device for automatically closing a door in response to a predetermined condition, such as fire, is provided by a selectively disengageable brake operatively associated with a pivotable door closure arm. The brake includes a flexible cable wrapped around a brake drum, and means to selectively tighten the cable around the drum. A crank-pin rotates conjointly with the drum and engages the door closure arm to expeditiously close the door in the event of fire.

13 Claims, 5 Drawing Figures

DOOR CLOSURE DEVICE

BACKGROUND OF THE INVENTION

This invention relates to a door-closure control system, and more particularly to a device that automatically closes the door in response to a predetermined condition.

In the event of fire it is of utmost importance to seal the entrance or passageway to any unexposed corridor, room, or office as quickly and as efficiently as is possible to prevent the fire from leaping into the unexposed area. Most entrances and passageways can be effectively sealed by simply closing the door leading to that passageway. By closing the door, substantially all the flames, gas fumes, smoke, and heat will be prevented from entering the unexposed area. Unfortunately, the door may not be closed in time to prevent catastrophe if the persons in the area are either unaware of the fire in some other part of the building, or are unable to close the door.

In hospitals and nursing homes, elderly persons, invalids, bedridden patients, handicapped and crippled individuals and wheelchair patients may not be able to close the door in the event of fire. Newborn infants and little babies are certainly unable to close any door in the event of fire. In houses, apartment buildings, hotels, motels and the like, individuals who are asleep as well as very young children may be unable to close the door to their rooms in case of fire. In warehouses, libraries, museums, and the like, sections may be temporarily unoccupied so that no one is present to close the door during a fire. At night, many public buildings, such as department stores, office buildings, and theatres have a substantial number of passageways and rooms that are unoccupied and therefore have no one to close the door in case of fire.

In the event of fire it is important to minimize the progress of the fire until firemen can be summoned to the scene to put out the fire. This can be accomplished by quickly enclosing the area being consumed by the fire. Automatic or remote control closing of doors in such areas is necessary to minimize the access of air to the fire. It is well known that even if there is sufficient fuel capable of being ignited, the fire will be extinguished if there is not sufficient air to support combustion.

It is also very desirable to provide for remote control closing of a door during certain times of the day or night. It may also be desirable to provide automatic door closing in response to some other condition, such as flooding.

Furthermore, in hospitals and nursing homes, it is desirable to partially open the door to a desired position so as to allow circulation of air, and to permit nursing personnel to observe the patients in the rooms. In any occupied building, many persons desire to leave their doors partially or completely open for easy ingress and egress and to enable them to observe the area on the other side of the door.

It is well known to provide doors with door checks, either of the hinge-type, usually mounted on the door or beneath the door, or of the surface-mounted type which are secured to the face of the door near the top edge. With either type, opening the door compresses a spring mechanism and expands a hydraulic piston and cylinder combination which fills from a hydraulic fluid reservoir. Sometimes the fluid reservoir is simply a portion of the cylinder on the other side of the piston. In any event, when the opened door is released, a spring urges the door toward the closed position, and the rate of movement of the door is regulated by controlling the rate at which the cylinder can empty. This is accomplished by causing the fluid to pass through passages controlled by one or more adjustable flow-restricting valves. Doors controlled by such mechanisms normally are retained in the closed position, although in some mechanisms, there is provision for holding the door open by such devices as detents which engage if the door is pushed open beyond its normal fully opened position. Conventional door checks of the foregoing type are described in U.S. Pat. Nos. 1,011,287 and 2,024,472. Fire doors are typically held open by a fusible link which melts when overheated and permits doors to close. Examples of such fusible-link fire-doors are described in U.S. Pat. Nos. 1,179,384 and 1,851,260.

Electromagnetic door closures are known wherein an electromagnet holds the door open until the circuit of the electromagnet is interrupted, but such devices do not allow for selective positioning of the door. A complex latching arrangement is shown in an electronically controlled hold-open device in U.S. Pat. No. 3,771,823. A complex hydraulic combined door-checking and door hold-open mechanism is shown in U.S. Pat. No. 3,696,462. While the present invention relates to hinge-type swinging or pivotable doors, and not sliding doors, of interest as showing the state of art in spring and line return mechanisms for sliding doors are U.S. Pat. Nos. 3,160,250 and 3,020,580. U.S. Pat. No. 3,332,638 illustrates a retractor device for closing a sliding door equipped with a band brake to damp the velocity of retraction.

One object of the present invention is to provide an improved door closure device that permits the door to be freely pivoted about its hinges to a desired position once the device is in a loaded or cocked position, so as to allow free circulation of air through the door passageway when the door is opened, permitting nursing personnel to observe patients in their rooms, and facilitating easy ingress and egress into the room, but which will cause the door to automatically close in the event of fire.

Another object of the invention is to provide a new and improved safety device that reliably and efficiently closes a door in the event of fire.

Still another object of this invention is to provide means responsive to the conditions of fire to automatically move a door to its closed position to retard the progress of the fire.

It is another object of this invention to provide an improved door closure device for preventing fire, smoke, gas fumes, and the like from entering the room of a patient who is unable to close the door.

It is also an object of this invention to provide a system for closing a door which may be activated manually or in response to a predetermined condition.

A further object of this invention is to provide an improved door closure device that operates expeditiously, is inexpensive to manufacture, dependable in operation, of simple design and construction, easy to operate, readily installed and removed from operating position, and capable of performing properly after long periods of use.

The foregoing and other objects and advantages of the invention will become apparent from the following description and appended claims.

DESCRIPTION OF THE PREFERRED EMBODIMENT

Figure 1:
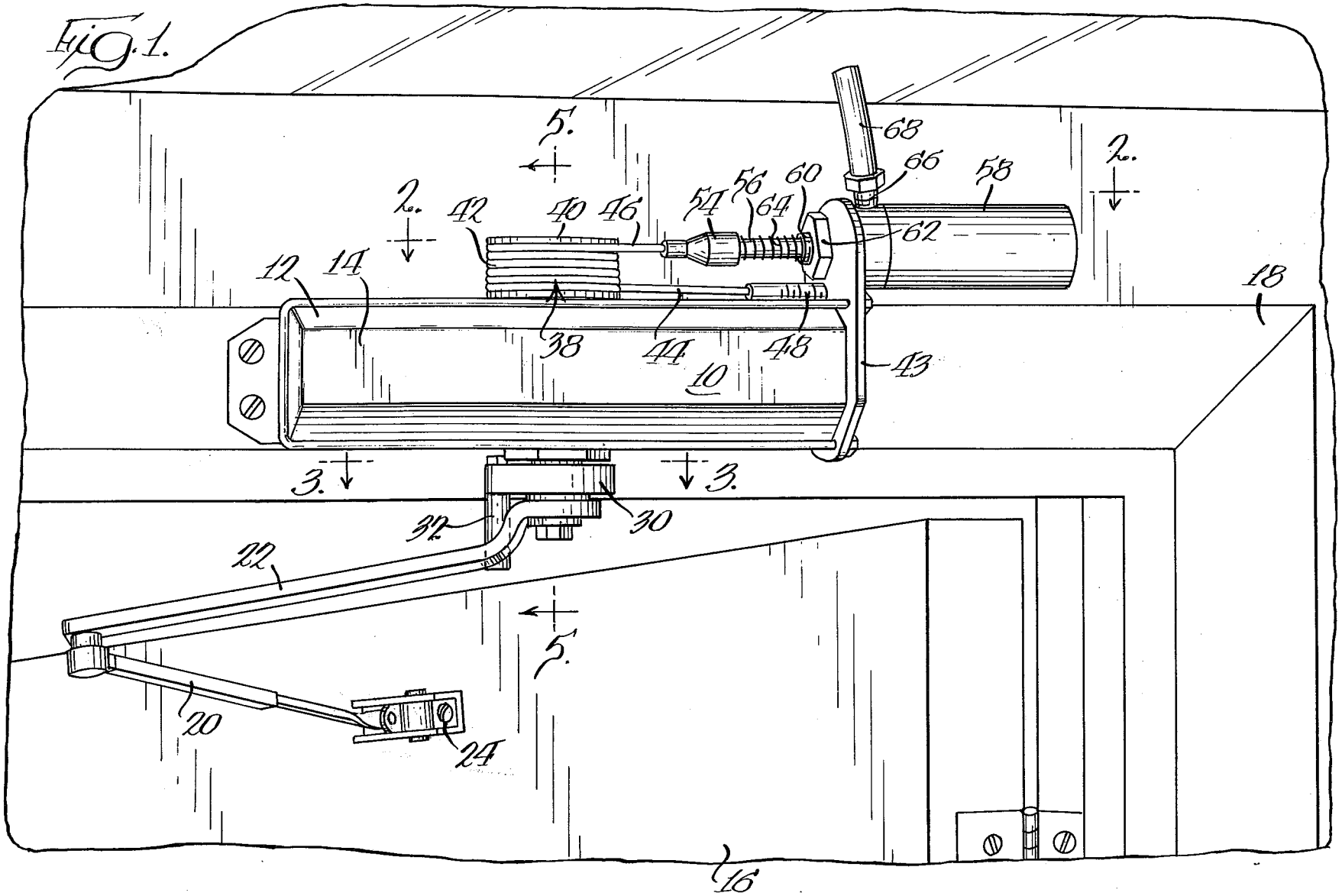
FIG. 1 is a perspective view of a door closure device constructed in accordance with the principles of the present invention.

Referring to the figures of the drawings, there is shown a door closure device, generally 10, including a housing 12 for a conventional door closing and checking mechanism 14. The conventional door closing and checking mechanism 14, such as but not limited to a Norton or Yale type closure unit, normally urges a door 16 to a closed position. Closure units as mechanism 14 which normally bias the door to a closed position are well known in the prior art and typically include a conventional force-producing mechanism contained in an internal chamber, such as a compression spring or some other type of spring, a hydraulic piston, some form of linkage mechanism, cam device, or gear train, or some form of electroservo-mechanism which may include solenoid valves, relay switches, and electromagnetic devices. Many of these prior art closure units also contain some type of damping device, such as a hydraulic piston or compression spring to damp the rate of closure so as to provide smooth and continuous closing of the door.

Conventional closure units, as mechanism 14, such as a "Norton 1600 Series Door Closure," may be mounted to a door frame 18 or wall, and may include a series of pivotable linkages connecting mechanism 14 to a hinged-door 16. Alternatively, the closure unit 14 could be mounted on door 16 and connected to the wall or some other fixed structure. In the illustrative embodiment only, the series of linkages includes a forearm 20 pivotally connected to a door-closure arm or linkage member 22, and a bracket 24 which is mounted on door 16. Forearm 20 may be adjustable in length.

Closure arm 22 is rotatable about a bushing 25 that has an elongated central bolt-receiving aperture therethrough. Bolt 27 is received by the bushing aperture and threadedly engages a complementary internally-threaded hole in a shaft 26, thereby aligning bushing 28 with shaft 26. An abutment crank 30 and a brake drum or spool 40 are mounted on squared opposite end portions 29 of shaft 26 for conjoint rotation with the latter, the spool 40 being secured to shaft 26 by a bolt 31. Extending from crank 30 is elongated pin 32 for abutment engagement with arm 22.

A brake assembly or clutch, generally 38, is provided to selectively prevent rotation of shaft 26. Brake 38 should be formed of a material of sufficient mechanical strength to safely withstand the maximum closing torque, yet capable of operating for long periods of use without excessive wear. The material forming brake 38 should also be of sufficient thermal conductivity to permit dissipation of any heat generated during braking.

Figure 2:
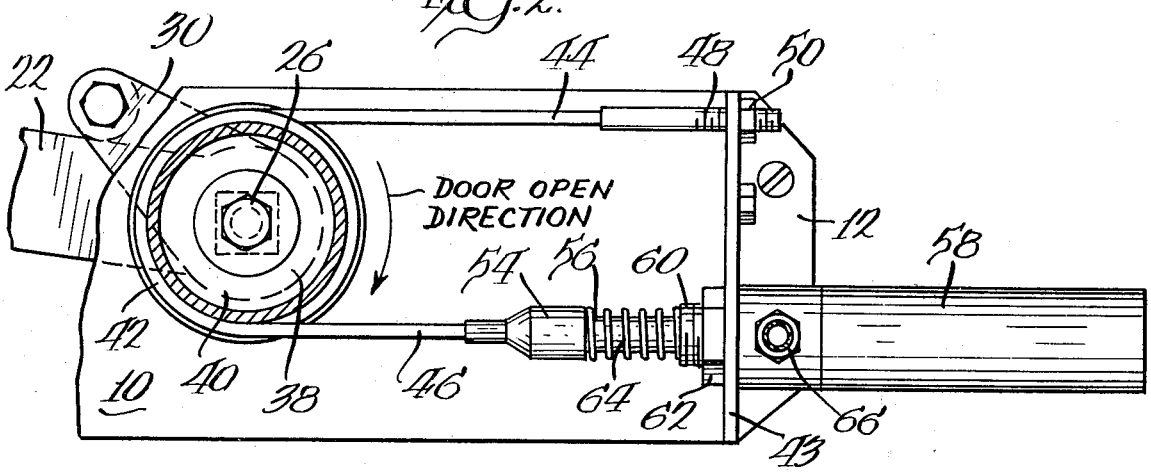
FIG. 2 is a fragmentary sectional view taken substantially along line 2—2 of FIG. 1 and showing the brake assembly.
Figure 3:
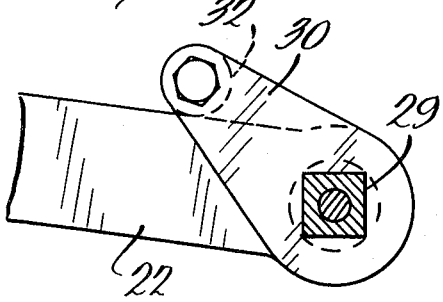
FIG. 3 is a fragmentary sectional view taken substantially along line 3—3 of FIG. 1 showing an abutment member engaging a pivotable door linkage arm during an automatic door closing operation.

Brake 38 preferably includes a flexible multiple-strand wire-cable 42 wrapped around brake-drum 40. A generally flat mounting plate 43 extends outward from housing 12 and is shaped to provide a stem-receiving aperture and a cylinder-receiving aperture. Cable 42 has an anchored or fixed end 44 connected to an elongated stem 48. Stem 48 has a threaded portion that is slidably receivable in the stem aperture defined by plate 43. A female threaded member, such as nut 50, engages the threaded portion of stem 48 as shown in FIG. 2. Cable 42 has another end 46 that faces a fluid cylinder 58 and is fixedly secured to a coupler 54. Coupling member 54 operatively connects cable end 46 to a piston rod 56. Rod 56 reciprocates into fluid cylinder 58 and carries a compression spring 64. Cylinder 58 has a threaded end 60 engageable in the cylinder-receiving aperture of plate 43 and faces cable end 46. A threaded cylinder-nut 62 engages cylinder end 60 for rigidly mounting the cylinder 58 against mounting plate 43. A hose-fitting 66 operatively connects hose 68 to fluid cylinder 58.

The braking capacity or torque is directly proportional to the total angular length and frictional contact between cable 42 and drum 40 and is therefore a function of the number of wrappings or windings of cable 42 about the circumference of drum 40. I have found that four or five wrappings work very satisfactorily. Drum 40 and cable 42 should be preferably formed of a material, such as metal, which is resistant to excessive wear.

In operation, to actuate brake 38, a fluid, preferably air, is injected into pneumatic cylinder 58 via hose 68 to apply a relatively small pressure, such as 20 psi, against a piston (not shown) associated with piston rod 56 thereby exerting a small pulling force on cable-end 46 to tighten cable 42 around drum 40. Injection of air into cylinder 58 may be accomplished by activating a three-way solenoid valve (not shown) operatively connected to hose 68. The solenoid valve may be activated by a relay electrically connected to a conventional remote-control fire detection system.

Once the cable is tightened around drum 40, door 16 should be opened to its maximum position, causing door arm 22 to movably engage pin 32 and rotate crank 30 to its maximum open position. Because shaft 26 is rotationally fixed with crank 30 and brake-drum 40, cranking or rotation of crank-member 30 will correspondingly rotate shaft 26 and drum 40, thereby compressing the usual door-closing spring (not shown) in closure unit 14 to its fully loaded position. As the door-closing spring is cranked to its fully loaded position, cable-end 46 will move toward drum 40 causing the cable 42 to slightly slacken about the drum 40, thereby allowing drum 40 to rotate without substantial frictional-braking interference with cable 42. Thus, uni-directional brake 38 does not operate in the direction of opening.

Figure 4:
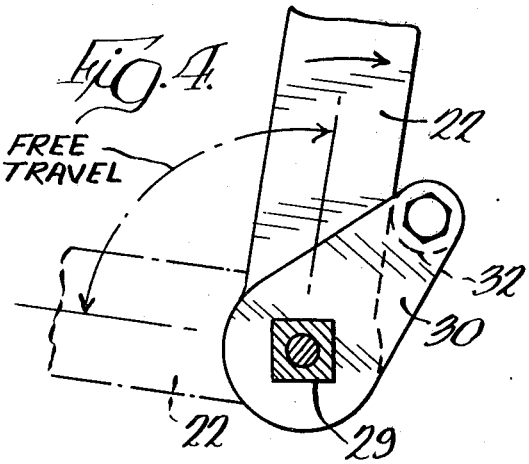
FIG. 4 is a view similar to FIG. 3 illustrating the pivotable door linkage arm being freely rotated during opening of the door until being stopped by the cocked abutment member.
Figure 5:
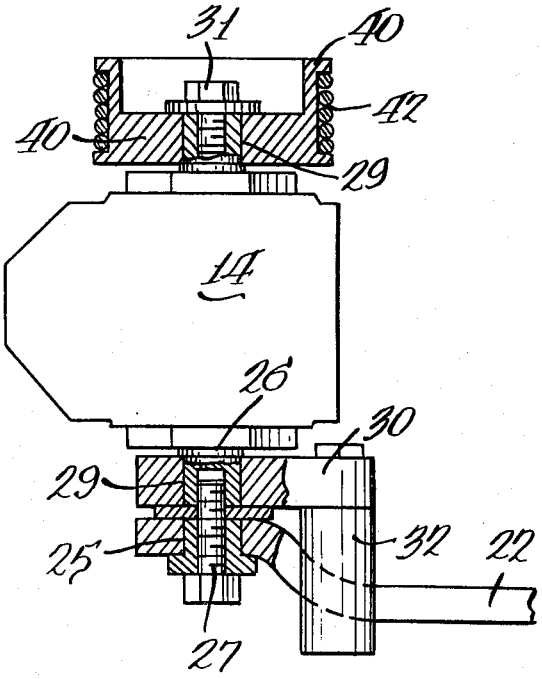
FIG. 5 is a fragmentary sectional view taken substantially along line 5—5 of FIG. 1 illustrating the brake drum, abutment member, and pivotable door linkage arm supported on a housing shaft.

Once the crank arm 30 is fully cocked to a clockwise position as shown in FIG. 4, brake 38 operates as a one-way clutch or brake in the direction of closure, pulling cable-end 46 away from drum 40 to tighten cable 42 around drum 40 as nut 50 is pulled against plate 43, thereby neutralizing and deactivating the normal closing bias of the door-closing spring in mechanism 14, and rendering the door-closing and checking mechanism 14 temporarily inoperable. Once door-closing spring in unit 14 is rendered inoperable by one-way brake 38, door-closure arm 22 is free to pivot or rotate about bushing 25 in both the opening and closing direction without further braking interference and will not be impeded by abutment pin 32 except in the maximum open position.

In the event of fire, the remote-control fire detection system causes its associated relay to de-energize the solenoid valve so that the air-pressure is released from the pneumatic cylinder 58. Rod-spring 64 will then urge coupler 54, piston rod 56 and cable-end 46 toward hub 40 to slacken cable 42 about drum 40, deactivating brake 38 and permitting drum 40 to freely rotate and slip relative to cable 42. Deactivation of the brake assembly 38 will remove the braking force that has neutralized the normal door-closing force of door-closing spring mechanism 14, so that the door-closing spring-member of unit 14 can rotate shaft 26 in the direction of closure, which will correspondingly rotate crank 30 toward door-closure arm 22, and cause pin 32 to movably engage door-closure arm 22 and close door 16.

During a fire, once the door is automatically closed, door 16 may be manually opened somewhat similar to a conventional door closure system. Movement of door 16 in the direction of opening, will cause door-arm 22 to movably engage crank-pin 30, thereby loading or cocking door-closing spring in unit 14. Door 16 may be repeatedly closed under the unimpeded closing force of the door-closing spring, somewhat similarly to a conventional door closure mechanism without a hold-open device, until brake 38 is actuated again when the fire detection system no longer senses a fire. Thus, it can be seen that brake assembly 38 is deactivated and rendered temporarily inoperable when the fire detection system senses a fire.

The conventional fire detection system is remotely connected to hose 68 and is responsive to some condition present in the event of fire, such as but not limited to heat, smoke, or gaseous fumes. While a fire detection system is preferred, other conventional detection systems or equipment may be used such as time-controlled devices, pressure sensitive mechanisms, or sensors which are responsive to the presence or lack of moisture. Closure device 10 may also be operatively connected to electrical or pneumatic switching means for manual remote closure of door 16. Furthermore, it should be understood that while a piston rod 58 is shown and described to reciprocate and operatively move cable-end 46, any equivalent means to effectively operate cable-end 46 could also be utilized, such as a diaphragm or electric solenoid operatively connected to cable 42.

Those skilled in the art will appreciate that an improved door closure device has been shown that automatically closes a door in the event of some predetermined condition, such as fire. It will be appreciated that numerous changes and modifications can be made to the embodiment shown herein without departing from the spirit and scope of this invention.

What is claimed and desired to be secured by Letters Patent of the United States is:

1. A door closer mechanism for automatically closing a door in response to a predetermined condition, the improvement comprising, in combination, a housing, a rotatable power shaft mounted in said housing and having a portion extending therefrom, force-producing means within said housing associated with said power shaft for rotatably biasing the latter in a door-closing direction, a door closure arm connected with a door to be controlled, said door closure arm being supported on said power shaft so as to be freely rotatable thereon, crank means fixedly mounted on said power shaft for conjoint rotation therewith, said crank means being engageable by said door closer arm when the latter is initially rotated in a door-opening direction thereby cocking said crank means and associated force-producing means while said door remains freely movable manually to any desired position between its fully open and fully closed positions, normally operable one-way brake means associated with said power shaft for preventing rotation of the latter in a door-closing direction, and means responsive to a predetermined condition for releasing said brake means enabling said force-producing means to rotate said power shaft and crank means in a door-closing direction whereby said crank means actuates said door closure arm to effect closing of said door.

2. A door closer mechanism as defined in claim 1 wherein said one-way brake means includes a brake drum fixedly mounted on said power shaft for conjoint rotation therewith.

3. A door closer mechanism as defined in claim 2 including a flexible cable wrapped around said brake drum, said cable being fixed at one end, and normally operable pulling means connected to the other end of said cable for applying a pulling force thereto tending to tighten said cable around said drum, said pulling force causing said cable to brake said brake drum against rotation in the direction of said pulling force while permitting rotation of said brake drum in an opposite direction when said door closer arm is initially rotated in a door-opening direction.

4. A door closer mechanism as defined in claim 3 where said cable is wrapped several times around the circumference of said brake drum.

5. A door closer mechanism for automatically closing a door in response to a predetermined condition, the improvement comprising, in combination, a housing, a rotatable power shaft mounted in said housing and having a portion extending therefrom, force-producing means within said housing associated with said power shaft for rotatably biasing the latter in a door-closing direction, a door closure arm connected with a door to be controlled, said door closure arm being supported on said power shaft so as to be freely rotatable thereon, crank means fixedly mounted on said power shaft for conjoint rotation therewith, said crank means being engageable by said door closer arm when the latter is initially rotated in a door-opening direction thereby cocking said crank means and associated force-producing means while said door remains freely movable manually to any desired position between its fully open and fully closed positions, normally operable one-way brake means associated with said power shaft for preventing rotation of the latter in a door-closing direction, said brake means including a brake drum fixedly mounted on said power shaft for conjoint rotation therewith, a flexible cable wrapped a plurality of times around the circumference of said brake drum, said cable being fixed at one end, normally operable pulling means connected to the other end of said cable for applying a pulling force thereto tending to tighten said cable around said drum, said pulling force causing said cable to brake said brake drum against rotation in the direction of said pulling force while permitting rotation of said brake drum in an opposite direction when said door closer arm is initially rotated in a door-opening direction, said pulling means comprising pneumatic means operable by a pre-determined air pressure, and means responsive to a pre-determined condition for releasing said air pressure and thereby releasing said brake means enabling said force-producing means to rotate said power shaft and crank means in a door-closing direction whereby said crank means actuates said door closure arm to effect closing of said door.

6. A door closer mechanism as defined in claim 5 wherein said pulling means comprises a piston-cylinder assembly including a piston rod connected with said other end of said cable.

7. A door closer mechanism as defined in claim 5 wherein said power shaft extends transversely through said housing with the opposite ends of said power shaft projecting above and below said housing respectively, said brake drum being mounted on one end of said power shaft and said crank means being mounted on the other end of said power shaft, and said brake drum and crank means both being fixed to said power shaft for conjoint rotation therewith.

8. A door closer mechanism as defined in claim 1 where said crank means includes a crank pin which is engageable by said door closure arm when the latter is initially rotated in a door-opening direction, and which actuates said door closure arm in response to said predetermined condition.

9. A door closer mechanism for automatically closing a door in response to a predetermined condition, the improvement comprising, in combination, a housing, a rotatable power shaft mounted in said housing and having a portion extending therefrom, force-producing means within said housing associated with said power shaft for rotatably biasing the latter in a door-closing direction, a door closure arm connected with a door to be controlled, said door closure arm being actuated from said power shaft, normally operable one-way brake means associated with said power shaft for preventing rotation of the latter in a door-closing direction, said brake means including a brake drum fixedly mounted on said power shaft for conjoint rotation therewith, a flexible cable wrapped around said brake drum, said cable being fixed at one end, normally operable pulling means connected to the other end of said cable for applying a pulling force thereto tending to tighten said cable around said brake drum, said pulling force causing said cable to brake said brake drum against rotation in the direction of said pulling force while permitting rotation of said brake drum in the opposite direction, and means responsive to a predetermined condition for releasing said pulling force thereby releasing said brake means enabling said force-producing means to rotate said power shaft in a door-closing direction to actuate said door closure arm and effect closing of said door.

10. A door closer mechanism as defined in claim 9 where said cable is wrapped several times around the circumference of said brake drum.

11. A door closer mechanism as defined in claim 9 where said pulling means comprises pneumatic means operable by a predetermined air pressure, and means responsive to said predetermined condition for releasing said air pressure.

12. For use with a door closer mechanism of the type having a housing, a rotatable power shaft mounted in said housing and having a portion extending therefrom, force-producing means within said housing associated with said power shaft for rotatably biasing the latter in a door-closing direction, and a door closure arm connected with a door to be controlled and actuated from the power shaft, the improvement comprising, in combination, a one-way brake including a brake drum fixedly mounted on said power shaft for conjoint rotation therewith, a flexible cable wrapped around said brake drum, said cable being fixed at one end, normally operable pulling means connected to the other end of said cable for applying a pulling force thereto tending to tighten said cable around said brake drum, said pulling force causing said cable to brake said brake drum against rotation in the direction of said pulling force while permitting rotation of said brake drum in the opposite direction, and means responsive to a predetermined condition for releasing said pulling force thereby releasing said one-way brake enabling said force-producing means to rotate said power shaft in a door-closing direction to actuate said door closure arm and effect closing of said door.

13. The improvement as defined in claim 12 where said door closure arm is mounted so as to be freely rotatable relative to said power shaft, and crank means fixedly mounted on said power shaft for conjoint rotation therewith, said crank means being operable to actuate said door closure arm upon release of said one-way brake.

* * * * *